US008146951B2

(12) United States Patent
Tung

(10) Patent No.: US 8,146,951 B2
(45) Date of Patent: Apr. 3, 2012

(54) SCUPPER JOINT FOR SHIP

(75) Inventor: Chin-Chung Tung, Taipei Hsien (TW)

(73) Assignee: Marine Town Inc., Panchiao Taipei Hsing (TW)

( * ) Notice: Subject to any disclaimer, the term of this patent is extended or adjusted under 35 U.S.C. 154(b) by 323 days.

(21) Appl. No.: 12/454,688

(22) Filed: May 21, 2009

(65) Prior Publication Data

US 2010/0294186 A1 Nov. 25, 2010

(51) Int. Cl.
*F16L 3/04* (2006.01)

(52) U.S. Cl. ..... 285/139.1; 114/182

(58) Field of Classification Search ..... 285/139.1, 285/139.2, 139.3, 206, 208, 205, 239; 114/182, 114/183 R
See application file for complete search history.

(56) References Cited

U.S. PATENT DOCUMENTS 954,269 A * 4/1910 Durkee ..... 285/205
1,393,089 A * 10/1921 Collie ..... 285/206
2,137,223 A * 11/1938 Baxter ..... 285/206
3,177,014 A * 4/1965 Bergstrom ..... 285/206
5,273,466 A * 12/1993 Thompson ..... 440/88 R
5,456,499 A * 10/1995 Sharpe ..... 285/206
5,722,339 A * 3/1998 Gross ..... 114/183 R
5,806,454 A * 9/1998 McKiernan et al. ..... 285/139.1
6,038,992 A * 3/2000 Smith ..... 114/183 R
6,164,231 A * 12/2000 Shimmell et al. ..... 114/182
6,736,081 B1 * 5/2004 Green et al. ..... 114/183 R
7,210,423 B2 * 5/2007 Haugen ..... 114/183 R

* cited by examiner

*Primary Examiner* — David E Bochna
(74) *Attorney, Agent, or Firm* — Charles E. Baxley

(57) ABSTRACT

A scupper joint for a ship includes a body and a nut. The body has a tubular structure as a piece cut from a seamless tube. The tubular structure has a first section and a second section. The first section has a flange at one end thereof as an evagination and a threaded segment at an outer periphery thereof. The second section has at least one annular protrusion at an outer periphery thereof. The nut has an annular structure. The tubular structure has an end evaginated to form a flange and has an inner wall threaded to form a threaded segment. The threaded segment of the nut and the threaded segment of the first section are configured to couple with each other.

3 Claims, 6 Drawing Sheets

SCUPPER JOINT FOR SHIP

BACKGROUND OF THE INVENTION

1. Technical Field

The present invention relates to scupper joints for ships. More particularly, the present invention relates to a scupper joint provided at a lower lateral portion of a ship hull, wherein the scupper joint is connected with a pumping plant installed in the ship hull for allowing water drawn by the pumping plant to be discharged out of the ship hull through the scupper joint.

2. Description of Related Art

Referring to FIG. 1, on a ship, a plurality of scupper joints 1 provide at a lower lateral portion of a ship hull are connected with a pumping plant in the ship. The pumping plant serves to draw water from a bottom tank or a cooling system of the ship and discharge the water out of the ship through the scupper joints 1.

The conventional scupper joint, as shown in FIG. 2, comprises a tubular body 10 and a locking ring 11 that is mounted around and thereby coupled with the body 10. The body 10 is axially, centrally formed with a through hole 101. The body 10 is also peripherally formed with a flange 12, a threaded segment 13 and a connecting segment 14. Another threaded segment 111 is formed at an inner periphery of the locking ring 11 for getting coupled with the threaded segment 13 of the body 10. By screwing the locking ring 11, the locking ring 11 is tightened and moves along the threaded segment 13 of the body 10 so that adjacent surfaces 122, 112 of the flange 12 and the locking ring 11 pressingly abut against an inner lateral 191 and an outer lateral 192 of a hull 19 of the ship, respectively. Some protrusions 141 are formed at an outer periphery of the connecting segment 14 for facilitating combination between the connecting segment 14 and an external plastic pipe 15. When the plastic pipe 15 is further communicated with a pumping plant, water pumped by the pumping plant can be discharged out of the ship through the hole 101 of the body 10.

For preventing rust thereon, the body 10 and the locking ring 11 are usually made of stainless steel through a casting process and then processed to have the aforementioned threaded segments and protrusions. Since the casting process requires a long production cycle in addition to expensive modules, for satisfying buyers' unscheduled component demands, the manufacturing may have to produce for inventory, thus adding burden to inventory turnover and management. Besides, while being hedged about the availability of existing modules, provision of the products is far from flexible. On the other hand, through the casting process, it is difficult, if not impossible, to make the body 10 have a wall thickness less than 2 mm without causing a high defective rate.

Consequently, the resultant scupper joint is bulky and heavy, thus requiring increased packing and transporting costs.

Moreover, the body 10 made of stainless steel can still rust after long-term contact with water. As a result, the rust scales can block the hole 101 and significantly weaken the discharging capacity of the scupper joint, rendering a shortened service life of the scupper joint. In view of this, some known approaches have suggested further preventing rust by making the parts with anticorrosive metal materials, such as titanium alloy. However, the expensive materials make the products become too expensive to be classed as economical. Other processes, such as vacuum casting and powder metallurgy, have been proposed as alternative approaches to make the wall thickness of the body 10 thinner than 2 mm. Nevertheless, theses processes require remarkable costs in modules and operation as compared with the aforesaid casting process does. As a result, the expensive processes make the products become too expensive to be classed as economical.

SUMMARY OF THE INVENTION

Hence, the primary objective of the present invention is to provide a scupper joint for a ship, wherein the scupper joint is not made through the known casting process or powder metallurgy process. Instead, the scupper joint has a body based on a piece cut from a seamless stainless steel tube that receives some known processes to have its designed configuration. As compared with the conventional scupper joints, the subject matter of the present invention is advantaged by saving costs in manufacture, development, packing and transportation, reducing a production cycle, thinning the scupper joint, ensuring discarding capacity, less burdening the ship, being highly anticorrosive, and being flexible to meeting customers' various components demands.

To achieve this and other objectives of the present invention, the scupper joint of the present invention comprises: a body, having a tubular structure as a piece cut from a seamless tube, wherein the tubular structure is processed to have a first section and a second section, the first section having a flange at one end thereof as an evagination and a threaded segment at an outer periphery thereof, and the second section having at lease one annular protrusion at an outer periphery thereof; and a nut, having an annular structure as a piece cut from a stainless steel board, wherein the tubular structure is processed to have an end evaginated to form a flange and is processed to have an inner periphery threaded to form a threaded segment, wherein the threaded segment of the nut and the threaded segment of the first section are configured to couple with each other.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE PREFERRED EMBODIMENT

Figure 1:
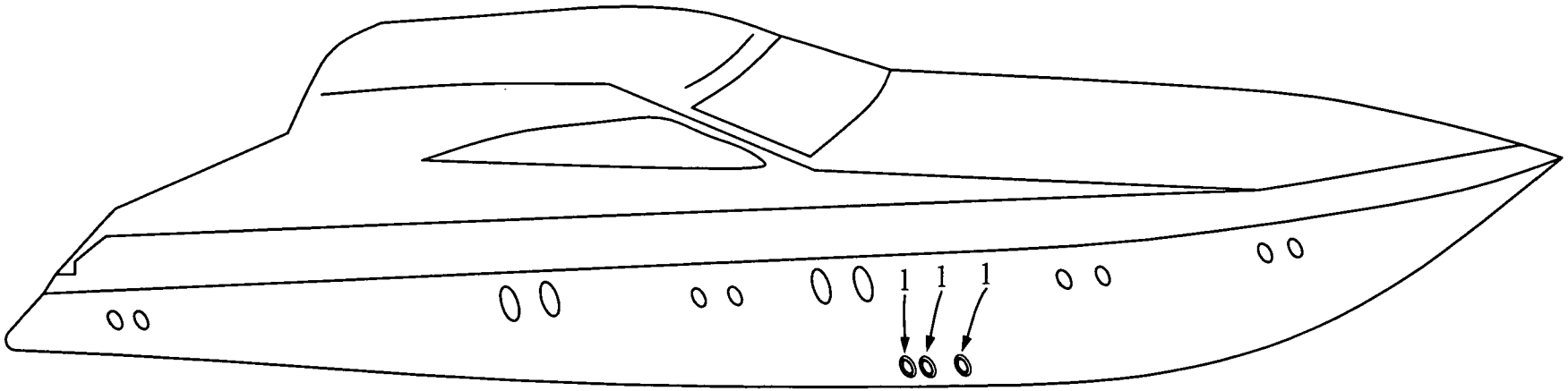
FIG. 1 is a schematic drawing showing scupper joints provided on a ship.
Figure 2:
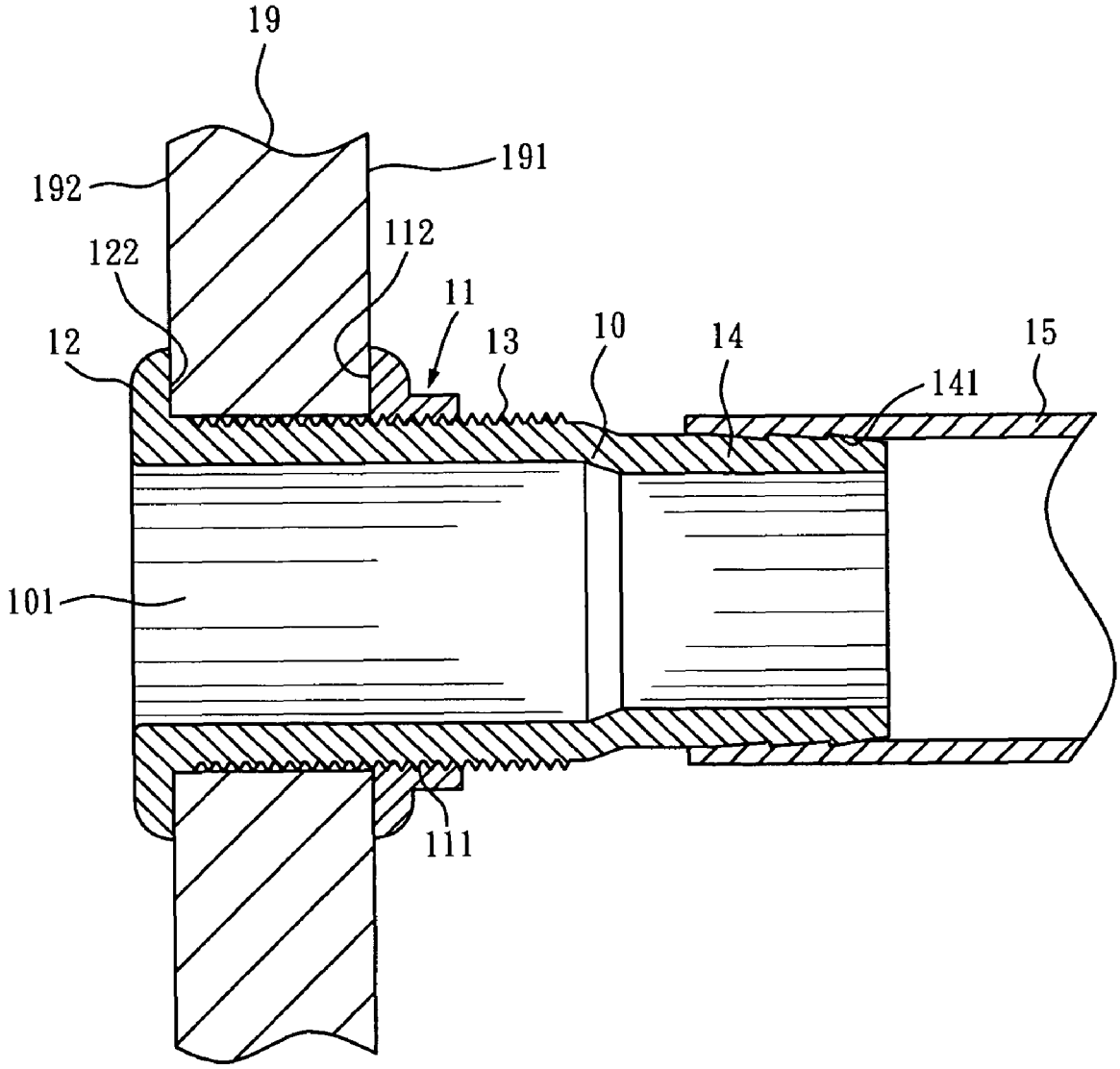
FIG. 2 PRIOR ART
FIG. 2 is a sectional view of a conventional scupper joint made through a casting process.
Figure 3:
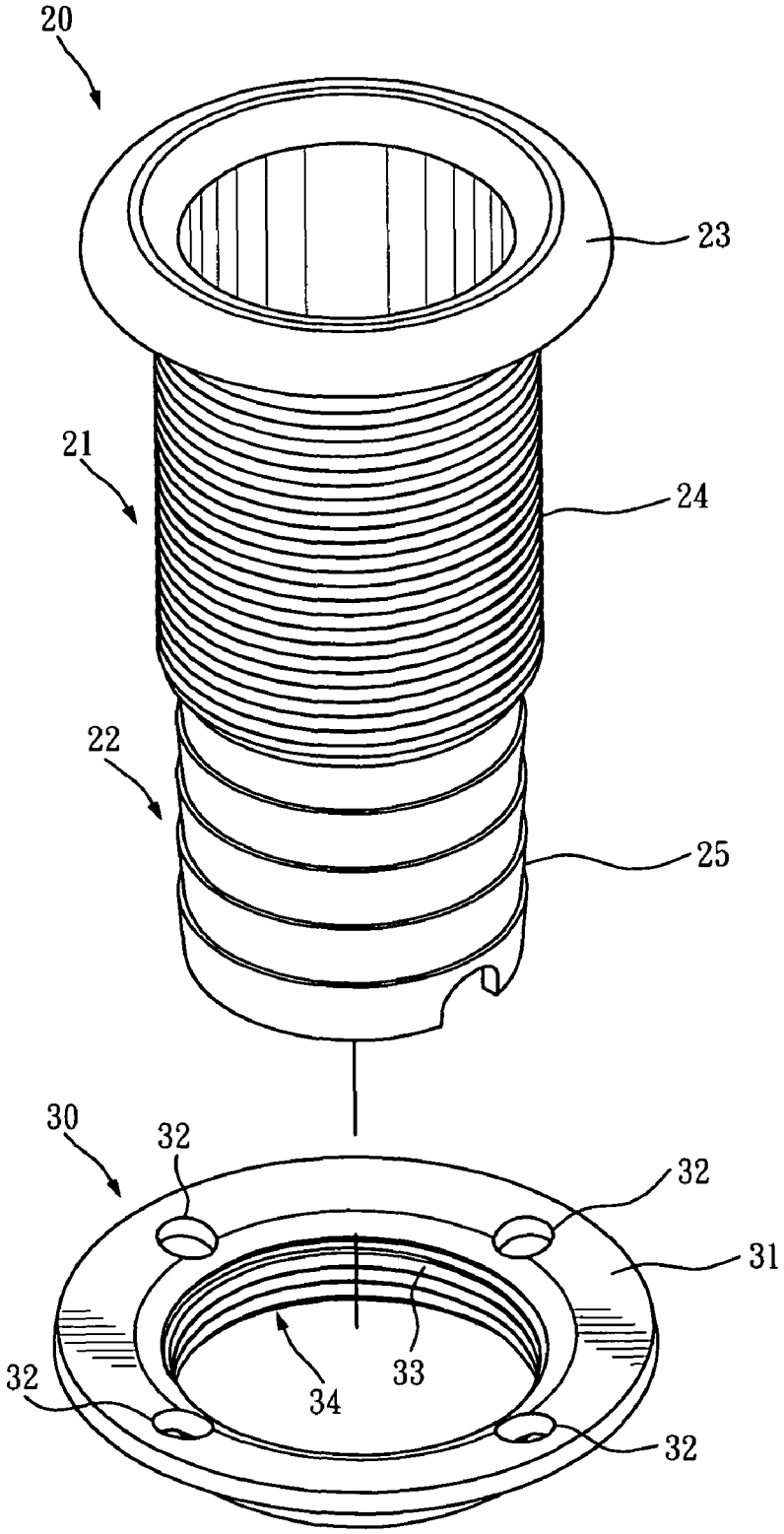
FIG. 3 is an exploded view of a scupper joint of the present invention.
Figure 4:
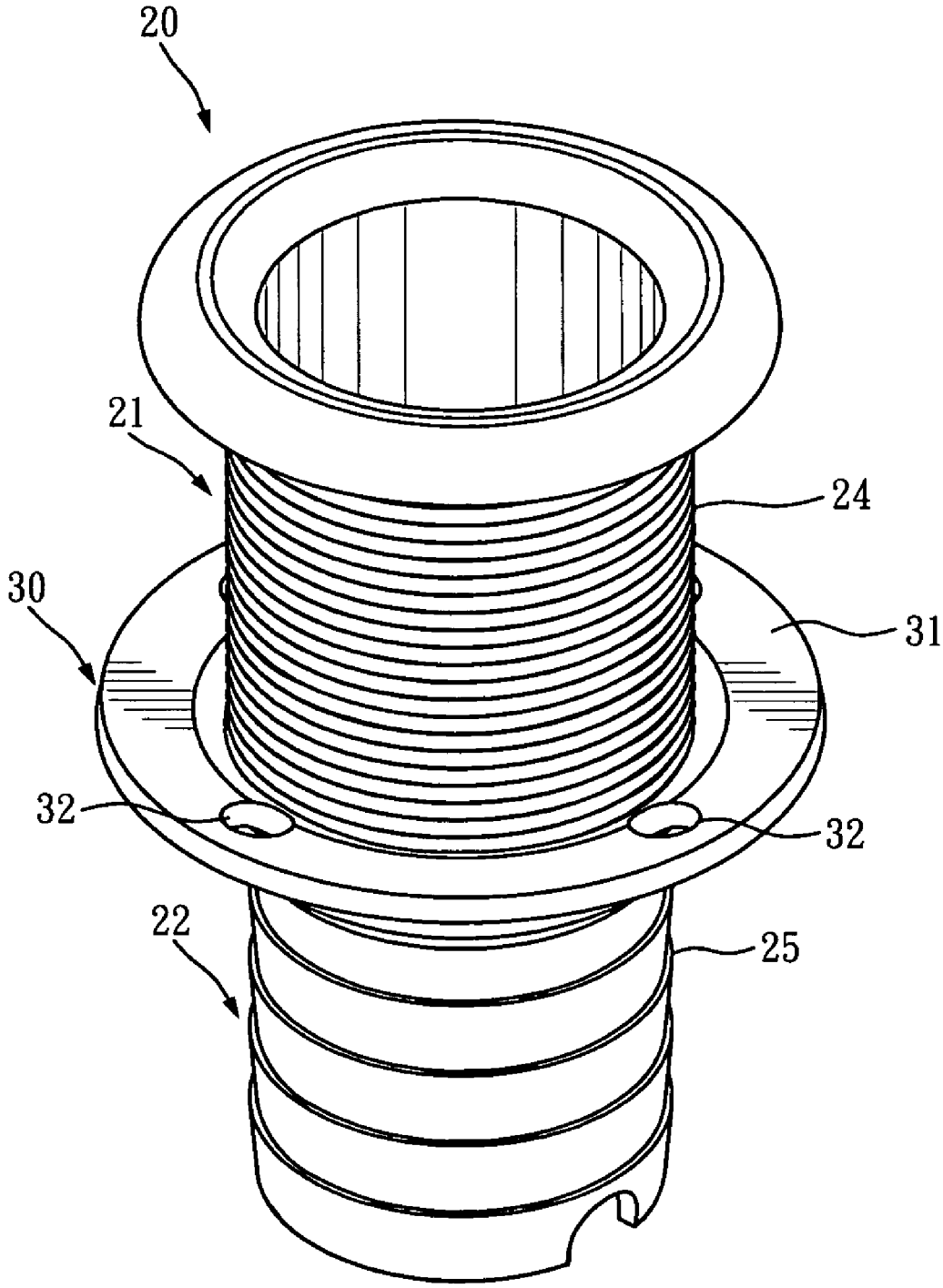
FIG. 4 is an assembled view of the scupper joint of the present invention.
Figure 5:
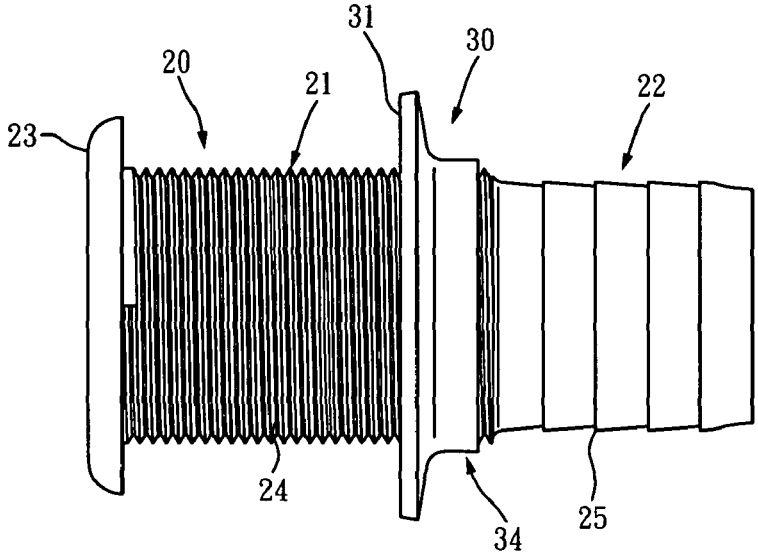
FIG. 5 is a lateral view of the assembled scupper joint of the present invention.
Figure 6:
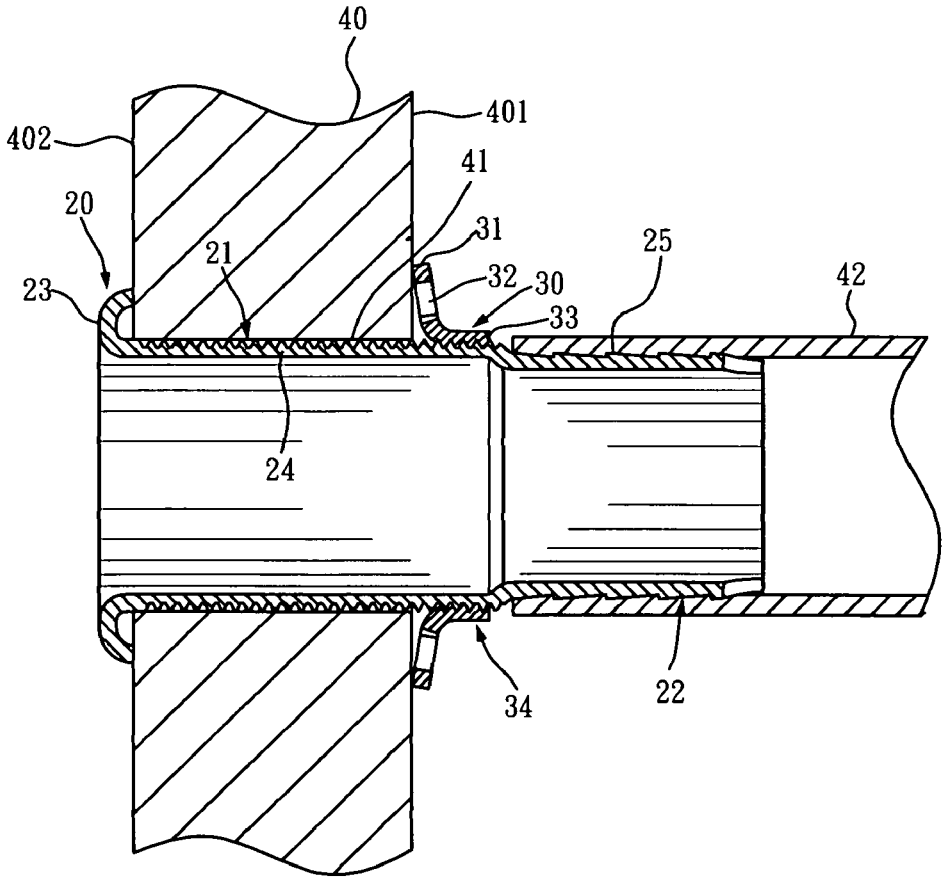
FIG. 6 is a sectional view of the scupper joint of the present invention.

While a preferred embodiment is provided hereinafter for illustrating the concept of the present invention as described above, it is to be understood that the components of the embodiment shown in the accompanying drawings are depicted for the sake of easy explanation and need not to be made in scale. Moreover, in the following description, resemble components are indicated by the respectively identical numerals.

Please refer to FIGS. 3 through 6. A scupper joint disclosed in the present invention comprises a body 20 and a nut 30 that is mounted around and thereby coupled with the body 20.

The body 20 has a tubular structure that includes a first section 21 and a second section 22. The first section 21 and the second section 22 are intercommunicated and extending linearly, axially inside the body 20. Therein, the second section 22 is formed through a tube reducing process so that its inner diameter and its outer diameter are smaller than those of the first section 21. An open end of the first section 21 is evaginated to form a flange 23 and an outer periphery of the first section 21 is formed with a threaded segment 24. A plurality of annular protrusions 25 are provided at an outer periphery of the second section 22.

The nut 30 has an annular structure whose one end has a flange 31 and an opposite end has a ring portion 34. The flange 31 comprises a tool-positioning portion. In the present embodiment, the tool-positioning portion is composed of four holes 32 each separated by 90 degrees from adjacent said holes 32 along an outer periphery of the flange 31. The holes 32 are provided to facilitate positioning a hand tool when the hand tool is operated by a user to tighten the nut 30 that has a threaded segment 33 formed on an inner periphery thereof.

The body 20 is settled in a hole 41 preformed on a ship hull 40. Then the nut 30 and the body 20 are mutually coupled by the threaded segments 33, 24 thereof. By screwing the nut 30, the nut 30 is tightened and moves along the first section 21 so that the flanges 23, 31 pressingly abut against an inner lateral 401 and an outer lateral 402 of the ship hull 40, respectively, thus positioning the scupper joint of the present invention on the ship hull 40. A pumping plant, as described previously, is connected to the second section 22 through a plastic pipe 42. At this time, the annular protrusions 25 and an inner periphery of the pipe are mutually interfered and thus firmly engaged without risk of unintentional separation. Afterward, water drawn by the pumping plant can be discharged out of the ship through the scupper joint. In addition, any known waterproofing approach, such as applying silicon gel or using water-stop tape, may be implemented at a border between the body 20 and the hole 41 of the ship hull 40 so as to eliminated any interval therebetween, thereby preventing external water coming into the ship hull 40.

Figure 7:
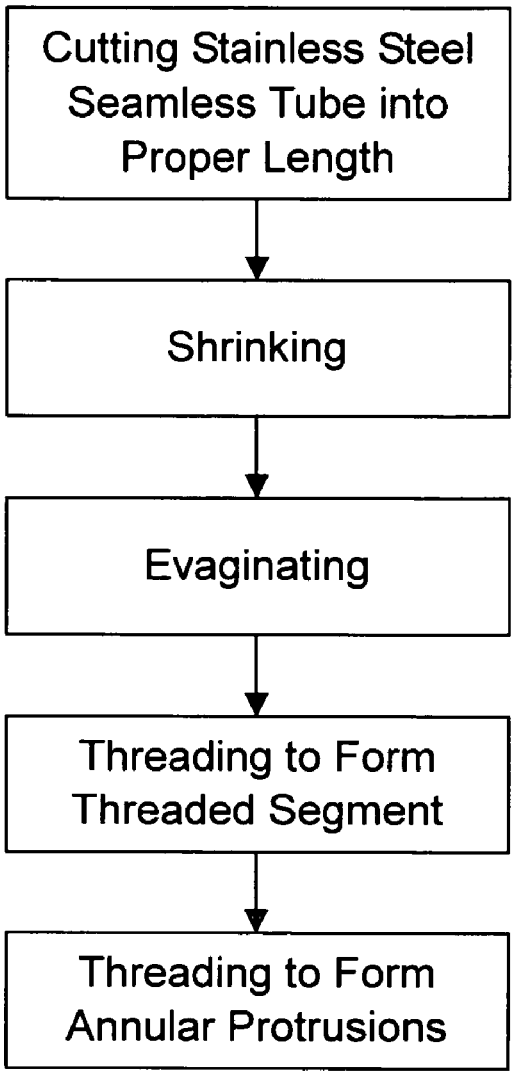
FIG. 7 is a flowchart for manufacturing the scupper joint of the present invention.

The body 20 is based on a piece cut from a seamless stainless steel tube and has a predetermined length. Then the piece after receiving processes for evaginating, threading, and partially shrinking has the flange 23, the threaded segment 24, the second section 22 and the annular protrusions 25. FIG. 7 shows a flowchart for manufacturing the body 20, therein, following steps are performed:

Step 1: cutting a piece with a predetermined length from a seamless stainless steel tube;

Step 2: conducting a tube shrinking process to form the second section 22;

Step 3: conducting an evaginating process to form the flange 23;

Step 4: conducting a threading process on the first section 21 to form the threaded segment 24; and Step 5: conducting a threading process on the second section 22 to form the annular protrusion 25 so as to complete the body 20.

Therein, Step 2 and Step 3 may be exchanged in order.

Figure 8:
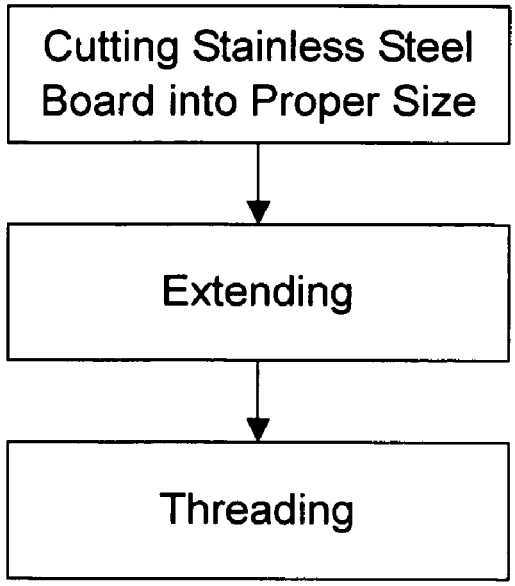
FIG. 8 is a flowchart for manufacturing the nut of the scupper joint of the present invention.

The nut 30 is based on a piece with a predetermined size cut from a stainless steel board. Then the piece after receiving processes for extending and threading, has the flange 31, the ring portion 34, the threaded segment 33 and the hole 32. FIG. 8 shows a flowchart for manufacturing the nut 30, therein, following steps are performed:

Step 1: cutting a piece with a predetermined size from a stainless steel board, wherein the piece has the hole 32 and the different hole to be later threaded;

Step 2: conducting an extending process to form the flange 31 and the ring portion 34; and Step 3: conducting a threading process in the ring portion 34 to form the threaded segment 33 so as to complete the nut 30.

Both the body 20 and the nut 30 are not made through the conventional casting process or powder metallurgy process. Instead, the body 20 is based on a piece cut from a seamless stainless steel tube while the nut 30 is based on a piece cut from a stainless steel board, both receiving known processing processes to form the body 20 and the nut 30 having the designed configurations. As compared with the conventional scupper joints, the present invention provides the following outstanding benefits.

The present invention facilitates saving the costs for casting modules and reducing the production cycle, thus eliminating the need of producing for inventory. Consequently, problems related to inventory turnover and management can be eliminated.

The present invention allows the body 20 to be made by cutting any seamless stainless steel tube meeting users' needs in diameter and length, thereby improving flexibility in manufacture of the body 20.

To improving economic and processing benefits, the seamless stainless steel tube may have a wall thickness of 2 mm. While the outer periphery of the body 20 is usually fixed to meet general specification required in ship industry, a thinner wall thickness of the adopted seamless stainless steel tube helps to increase the inner diameter of the body 20, and in turn increase the discharging capacity of the scupper joint. Also, the body 20 with less wall thickness is relatively light, thereby reducing the transportation cost and less burdening the ship.

Since the body 20, in use, comes to direct contact with water, the seamless stainless steel tube applied in the present invention is preferably one made of a material having excellent anticorrosive ability (such as low-carbon stainless steel) so as to ensure the anticorrosive and rust-proof ability of the body 20, thereby maximizing the service life of the scupper joint. On the other hand, the nut 30 that contacts no water in use may be made of a stainless steel board with relatively high carbon concentration, so as to reduce the material cost.

It is to be noted that the body 20 of the present invention shall be made of seamless stainless steel tubes only because steel tubes with welding seams can have cracks on the evagination and fail to meet industrial requests in dimensions. Besides, with identical steel properties, seamless stainless steel tubes present better anticorrosive ability than steel tubes with welding seams do.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A scupper joint for a ship, the scupper joint comprising:

a body, having a tubular structure as a piece with a predetermined length cut from a seamless tube, wherein the tubular structure is processed to have a first section and a second section, wherein the first section has a flange at one end thereof as an evagination and a threaded segment at an outer periphery thereof; and the second section has at lease one annular protrusion at an outer periphery thereof; and a nut, having an annular structure with the nut having:

a flange at an end thereof; and a threaded segment at an inner periphery thereof, wherein the threaded segment of the nut and the threaded segment of the first section are configured to couple with each other wherein the nut flange comprises a tool-positioning portion, and wherein the tool-positioning portion is four holes each separated by 90 degrees from adjacent said holes along an outer periphery of the flange.

2. The scupper joint of claim 1 wherein the second section is formed through a tube reducing process so that an inner diameter and an outer diameter of the second section are smaller than an inner diameter and the outer diameter of the first section.

3. The scupper joint of claim 1 wherein the seamless tube is made of stainless steel.

* * * * *